US007540041B2

(12) United States Patent
Gara et al.

(10) Patent No.: US 7,540,041 B2
(45) Date of Patent: Jun. 2, 2009

(54) COLLAPSIBLE TOILET

(76) Inventors: Péter Gara, Dózsa György u. 100, Törökbálint (HU) H-2045; Domonkos Hollósi, Radna u. 12, Budapest (HU) H-1026

( * ) Notice: Subject to any disclaimer, the term of this patent is extended or adjusted under 35 U.S.C. 154(b) by 650 days.

(21) Appl. No.: 10/532,318

(22) PCT Filed: Dec. 17, 2002

(86) PCT No.: PCT/HU02/00147

§ 371 (c)(1),
(2), (4) Date: Apr. 22, 2005

(87) PCT Pub. No.: WO2004/037062

PCT Pub. Date: May 6, 2004

(65) Prior Publication Data

US 2006/0150312 A1 Jul. 13, 2006

(30) Foreign Application Priority Data

Oct. 25, 2002 (HU) ..... 0203630

(51) Int. Cl.
*A47K 11/04* (2006.01)

(52) U.S. Cl. ..... 4/483; 4/449; 4/460; 4/484; 297/440.12

(58) Field of Classification Search ..... 4/449, 4/460, 476, 483, 484; 297/440.12
See application file for complete search history.

(56) References Cited

U.S. PATENT DOCUMENTS

| | | | | |
|---|---|---|---|---|
| 5,040,249 | A | 8/1991 | Diaz | |
| 5,524,301 | A * | 6/1996 | McGuire | 4/460 |
| 5,682,623 | A * | 11/1997 | Fenoglio | 4/483 |
| 5,732,418 | A | 3/1998 | Sekitou | |
| 5,852,832 | A * | 12/1998 | Voigt et al. | 4/484 |

FOREIGN PATENT DOCUMENTS

| | | |
|---|---|---|
| DE | 299 09 244 U | 11/1999 |
| JP | 10-99236 | 4/1998 |

* cited by examiner

*Primary Examiner*—Tuan N Nguyen
(74) *Attorney, Agent, or Firm*—Fox Rothschild, LLP

(57) ABSTRACT

The invention is a collapsible toilet made of sheet material, the toilet comprising holding side walls to which two edges of an annular seat surface are joined, and supporting side walls connecting the holding side walls and having upper edges forming a supporting periphery that supports the seat surface. In the seat surface a fold-line is arranged at an equal distance from the top edges of the holding side walls, said fold-line enabling folding the seat surface into the inner space when the holding side walls are moved towards each other.

5 Claims, 8 Drawing Sheets

COLLAPSIBLE TOILET

TECHNICAL FIELD

The present invention relates to a collapsible toilet which is made of sheet material, the toilet comprising side walls connected to each other at their lateral edges and defining an inner space of the toilet, a seat surface arranged at the upper edges of the side walls, and fold-lines for collapsing the toilet.

BACKGROUND ART

Especially for families travelling with small children and for persons accompanying children, it is a requirement to have a compact toilet which can be carried for example in a bag or pocket, and which can be folded, quickly unfolded and taken into use.

There are numerous attempts for designing portable toilets or potties especially for small children.

Several prior art attempts involve a constant size toilet made of hard, self-supported, injection moulded or pressed plastic. It is a fundamental disadvantage of constant-size approaches that the relatively large size allows limited mobility only, therefore restricting availability. Such types of toilets can be transported for example in a car boot, but may not be carried with ease by a child minder on a long-term basis.

For example, in U.S. Pat. No. 2,974,321 and U.S. Pat. No. 4,633,536 toilets are disclosed that can be opened like a small carrying case. These approaches only partly remedy the shortfall described above. The size is still too large for a child minder to carry the toilet with ease.

There are designs that use an assembly consisting of several pieces. Such approaches are disclosed in U.S. Pat. No. 3,118,146, U.S. Pat. No. 3,484,875, U.S. Pat. No. 3,600,719, U.S. Pat. No. 4,710,989, U.S. Pat. No. 4,995,122, U.S. Pat. No. 5,448,785, U.S. Pat. No. 5,732,418, U.S. Pat. No. 6,061,845 and JP 02189119. The disadvantages in this case are that setting up from a disassembled condition is overcomplicated and takes a long time, and furthermore that the folding of the toilet to a small size is not possible.

Collapsible toilets assembled from flat-folded sheets are also known. Such approaches are described for example in U.S. Pat. No. 2,849,726, U.S. Pat. No. 2,893,017, U.S. Pat. No. 2,912,702, U.S. Pat. No. 3,097,016, U.S. Pat. No. 3,159,848, U.S. Pat. No. 3,319,263, U.S. Pat. No. 5,187,819, U.S. Pat. No. 5,524,301, U.S. Pat. No. 5,682,623, U.S. Pat. No. 6,047,414, DE 296 07 144 U1, FR 2 638 628, JP 02119828, JP 04114618, JP 11155766, WO 98/29019 and WO 00/59355. The disadvantages of these toilets are that generally the assembly from an unfolded status is overcomplicated and takes a long time, consequently the period of preparing the unit for use is very long. It is also a general disadvantage that the width and height of flat-folded panels are too large for carrying the unit with ease, and the most frequent reason for this is that the seat surface cannot be folded. Designs without a seat surface are disadvantageous due to the discomfort hence caused. A further disadvantage is that an eventual receptacle bag can only be fitted subsequently and with difficulty into these prior art toilets.

A toilet consisting of a sheet material and having a foldable structure is described in U.S. Pat. No. 5,040,249. This prior art toilet can be unfolded relatively easily, but it is a disadvantage that in a folded status it is very thick due to the numerous layers of the complicated internal structure. A further basic disadvantage is that the seat surface of the unfolded structure is not well designed, and the user—for example a child—sits on two distant, ergonomically unfit surfaces or on the lateral edges.

A toilet assembled from a sheet material is described furthermore in DE 196 25 980 A1. An advantage of this solution is that the toilet has a seat surface, which is collapsible along a fold-line. It is a disadvantage, however, that due to the separate seat surface, the unfolding and assembly process is relatively complicated and the seat surface is not fixed in a steady way to the side walls of the toilet. The seat surface design does not allow the collapsing of the toilet to a small size necessary for portability and the load-bearing capacity of this design is also questionable.

DISCLOSURE OF INVENTION

The purpose of the invention is to provide a collapsible toilet which eliminates the above mentioned disadvantages of prior art approaches, can be folded and unfolded in the most simple way possible, in a collapsed condition has the smallest size possible, and has an ergonomic seat surface and appropriate load-bearing capacity in an unfolded position.

Therefore, the invention is a collapsible toilet made of sheet material, the toilet comprising side walls connected to each other at their lateral edges and defining an inner space of the toilet, a seat surface arranged at the upper edges of the side walls, and fold-lines for collapsing the toilet. The inventive toilet comprises two opposite holding side walls having top edges to which two edges of an annular seat surface are joined respectively along respective fold-lines, and supporting side walls connecting the holding side walls and having upper edges forming a supporting periphery that supports the seat surface, wherein in the seat surface a fold-line is arranged at an equal distance from the top edges of the holding side walls, said fold-line enabling folding the seat surface into the inner space when the holding side walls are moved towards each other.

The design according to the invention enables the seat surface to be folded into the inner space, thereby allowing a simple collapsing of the toilet to an extremely small size. The ergonomically designed seat surface is not separated from the toilet, and when it is folded, the seat is hygienically protected in the inner space against contamination. The supporting periphery formed by the upper edges of the supporting side walls and the continuity with the holding side walls provide appropriate stability and load-bearing capacity for the seat surface.

A preferred embodiment is characterised in that the seat surface is fixed to the supporting periphery at least at one location. Fixing is advantageous from the aspect of steadying the seat surface and the supporting side walls.

The seat surface preferably consists of seat surface segments, the said seat surface segments comprising a basic part joining the top edge of the holding side wall and two lateral parts extending towards the other seat surface segment, wherein opposite lateral parts of the seat surface segments are joined at their ends to each other along the fold-line, and wherein a fixing to the supporting periphery is located at the joining portions of the lateral parts. In this way the fold-line and the fixing can be designed simply.

The toilet is preferably made of a single piece of sheet material by cutting and gluing, wherein each seat surface segment is continuous with the respective holding side wall separated from it by a fold-line, and the ends of the lateral parts are provided with flaps bent perpendicular to the seat surface and glued to each other in pairs extending towards the supporting periphery, wherein the flaps have slots and are pressed with the slots on the supporting periphery or into further slots in the supporting periphery. Fixing by slots in the flaps results in a simple folding and unfolding procedure, and furthermore in a preferred embodiment the flaps serve as an appropriate handle for the folding operations.

In an especially preferred embodiment, there are two further fold-lines in each seat surface segment extending across a respective endpoint of the top edge of the holding side wall and normal to the edge, the two further fold-lines separating the basic part from the lateral parts, wherein the lateral parts are folded on the top surface of the basic part along these further fold-lines when folding the toilet, and the seat surface segments are folded into the inner space with the upright flaps by pushing the holding side walls together. With further fold-lines and in a special folding manner, the seat surface can be folded to a size smaller than any prior art solutions, which is advantageous from the aspect of portability.

It is a preferred embodiment, the toilet has a hexagonal inner space, the two holding side walls are connected to each other by pairs of supporting side walls on the two sides, and the slots in the supporting periphery are formed in each pair along the joint lateral edge of the supporting side walls.

In addition, the smallest possible folded size can be achieved when in a folded position the pairs of the supporting side walls are folded onto the outside of the respective pushed-together holding side walls. In this case, the largest main dimensions of the collapsed structure are determined by the sizes, i.e. the width and height, of a single side wall.

A receptacle bag open at the top can be fixed to the seat surface segments or to the side walls with a preferably releasable joint.

The toilet according to the invention is preferably made of corrugated paper or plastic.

BRIEF DESCRIPTION OF DRAWINGS

The invention will hereinafter be described on the basis of preferred embodiments depicted by the drawings, where.

MODES FOR CARRYING OUT THE INVENTION

Figure 10:
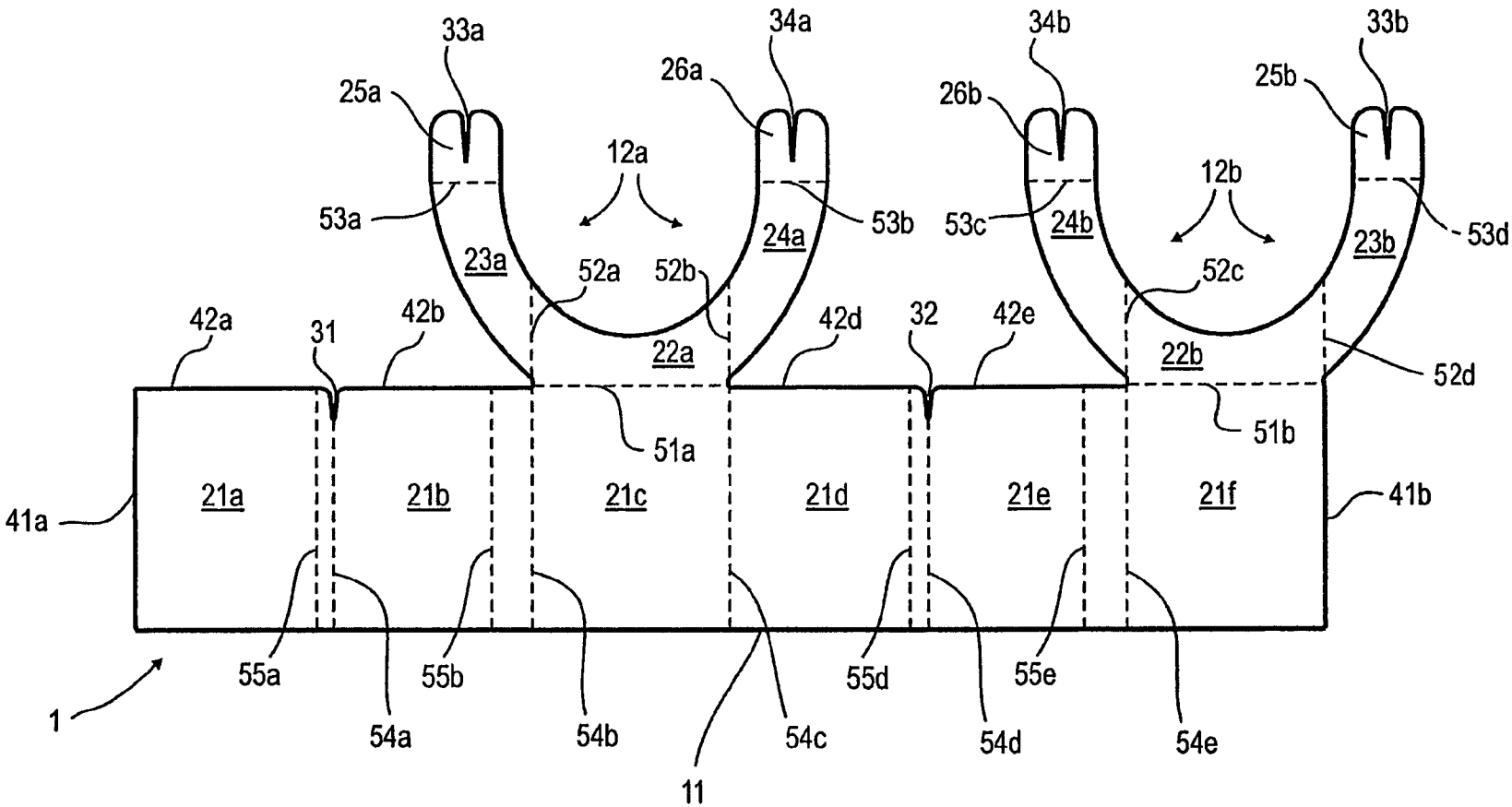

The collapsible and portable toilet or pocket potty shown in FIGS. 1 to 9 is preferentially made of a base form cut from corrugated paperboard or plastic or a similar thin-wall sheet material as shown in FIG. 10.

Figure 1:
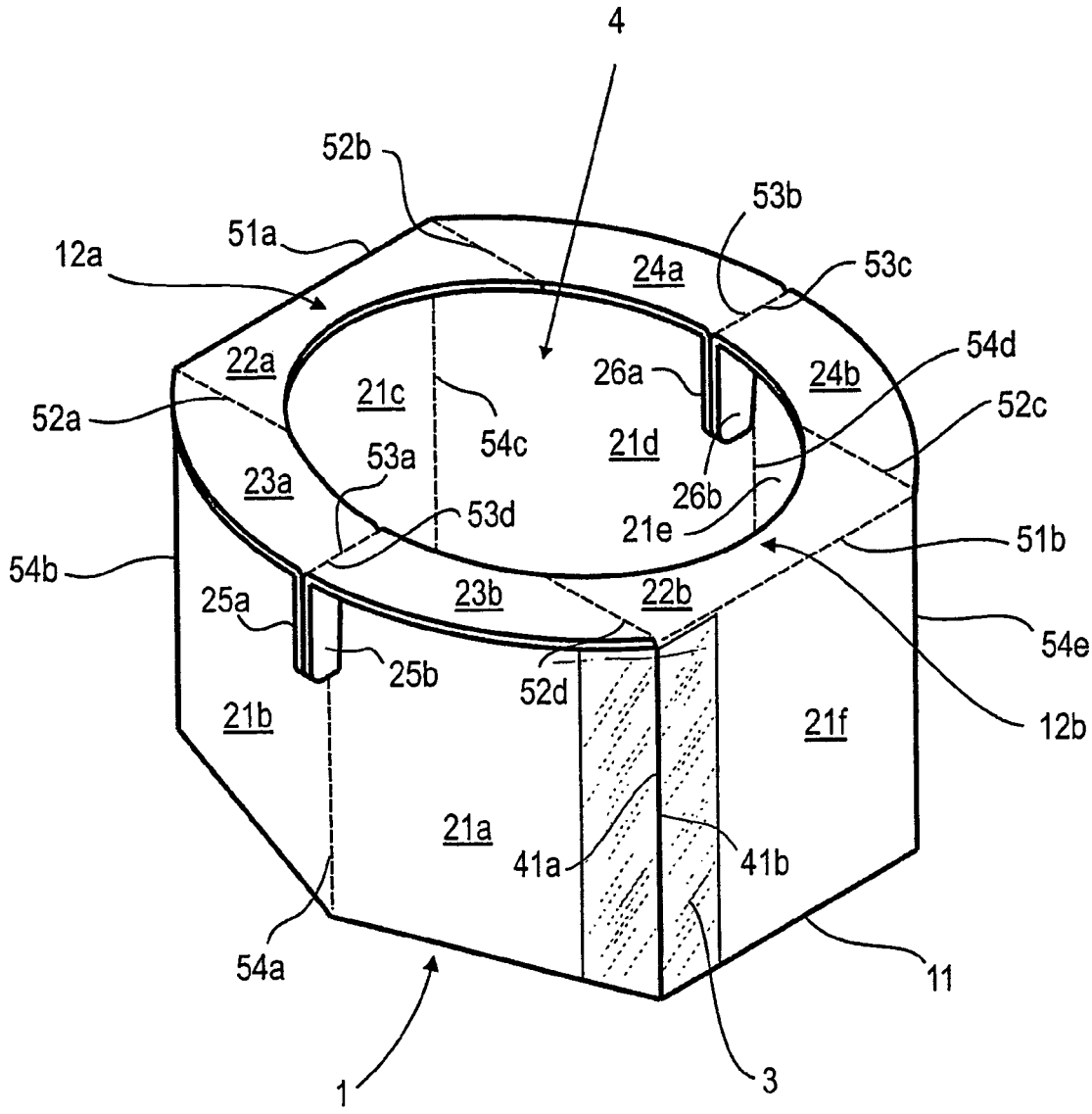
FIG. 1 is a view of the toilet according to the invention in an unfolded status ready for use.

In an unfolded position depicted by FIG. 1, the toilet 1 rests on a surface along its basic edge 11. The toilet 1 has vertical side walls that define its inner space 4 and are joined to one another at their lateral edges 54*a*, 54*b*, 54*c*, 54*d* and 54*e*. The two extreme edges 41*a*, 41*b* of the row consisting of side walls are secured to one another by an adhesive tape 3. Two of the side walls facing one another are called holding side walls 21*c*, 21*f*, and the upper edges 51*a*, 51*b* of these side walls are continuous along a fold-line with two edges of an annular seat surface consisting of seat surface segments 12*a*, 12*b*. The other side walls are called supporting side walls 21*a*, 21*b*, 21*d* and 21*e* and they form a supporting periphery holding the seat surface from the bottom with their upper edges 42*a*, 42*b*, 42*d* and 42*e*.

The seat surface segments 12*a*, 12*b* comprise a basic portion 22*a*, 22*b* joining the upper edges 51*a*, 51*b* of the holding side walls 21*c*, 21*f*, and two lateral parts 23*a*, 24*a*; 23*b*, 24*b* extending towards the other seat surface segment 12*a*, 12*b*. The ends of the lateral parts 23*a*, 24*a*; 23*b*, 24*b* located opposite one another are fitted with flaps 25*a*, 26*a*; 25*b*, 26*b* which are bent normal to the seat surface and glued in pairs to one another facing the supporting periphery, and with slots 33*a*, 34*a*; 33*b*, 34*b* in flaps 25*a*, 26*a*; 25*b*, 26*b* they are pressed into further slots 31, 32 in the supporting periphery. It can be seen that in the depicted embodiment the two holding side walls 21*c*, 21*f* are connected to each other by pairs of supporting side walls 21*a*, 21*b*; 21*d*, 21*e* on two sides, and the slots 31, 32 in the supporting periphery are formed in each pair along the joint lateral edge 54*a*, 54*d* of the supporting side walls 21*a*, 21*b*, 21*d*, 21*e*. Fixing the seat surface to the supporting periphery in such a way provides higher strength to the toilet 1 according to the invention.

According to the invention, at an equal distance from the upper edges 51*a*, 51*b* of the holding side walls 21*c*, 21*f*, a fold-line is formed in the seat surface which allows the seat surface to be folded in half and into the inner space 4 by moving the holding side walls 21*c*, 21*f* towards each other when collapsing. In the preferred embodiment depicted, the fold-line proceeds along the joining line of the lateral parts 23*a*, 24*a*; 23*b*, 24*b* facing each other.

In the preferred embodiment shown, there are two more fold-lines 52*a*, 52*b*; 52*c*, 52*d* in each seat surface segment 12*a*, 12*b*, which are extending across an end point of the top edge 51*a*, 51*b* of the holding side walls 21*c*, 21*f* and normal to the edges 51*a*, 51*b*, and which fold-lines separate the basic portions 22*a*, 22*b* from the relevant lateral parts 23*a*, 24*a*; 23*b*, 24*b*. These further fold-lines 52*a*, 52*b*; 52*c*, 52*d* enable in a way to be described later the collapsing of the toilet 1 to an even smaller size.

Figure 2:
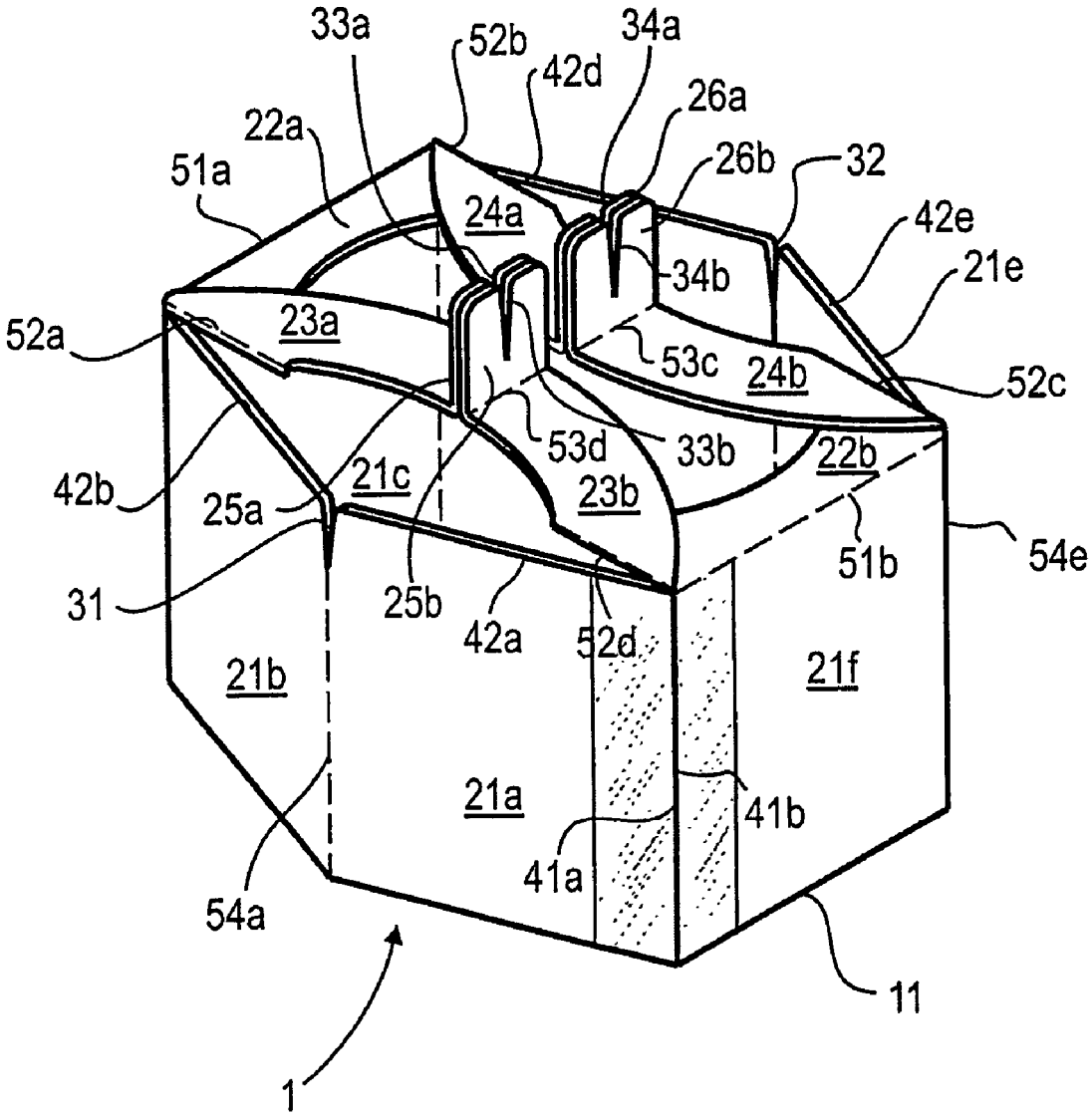
FIG. 2 is a view of the toilet shown in FIG. 1 in the first phase of collapsing.
Figure 3:
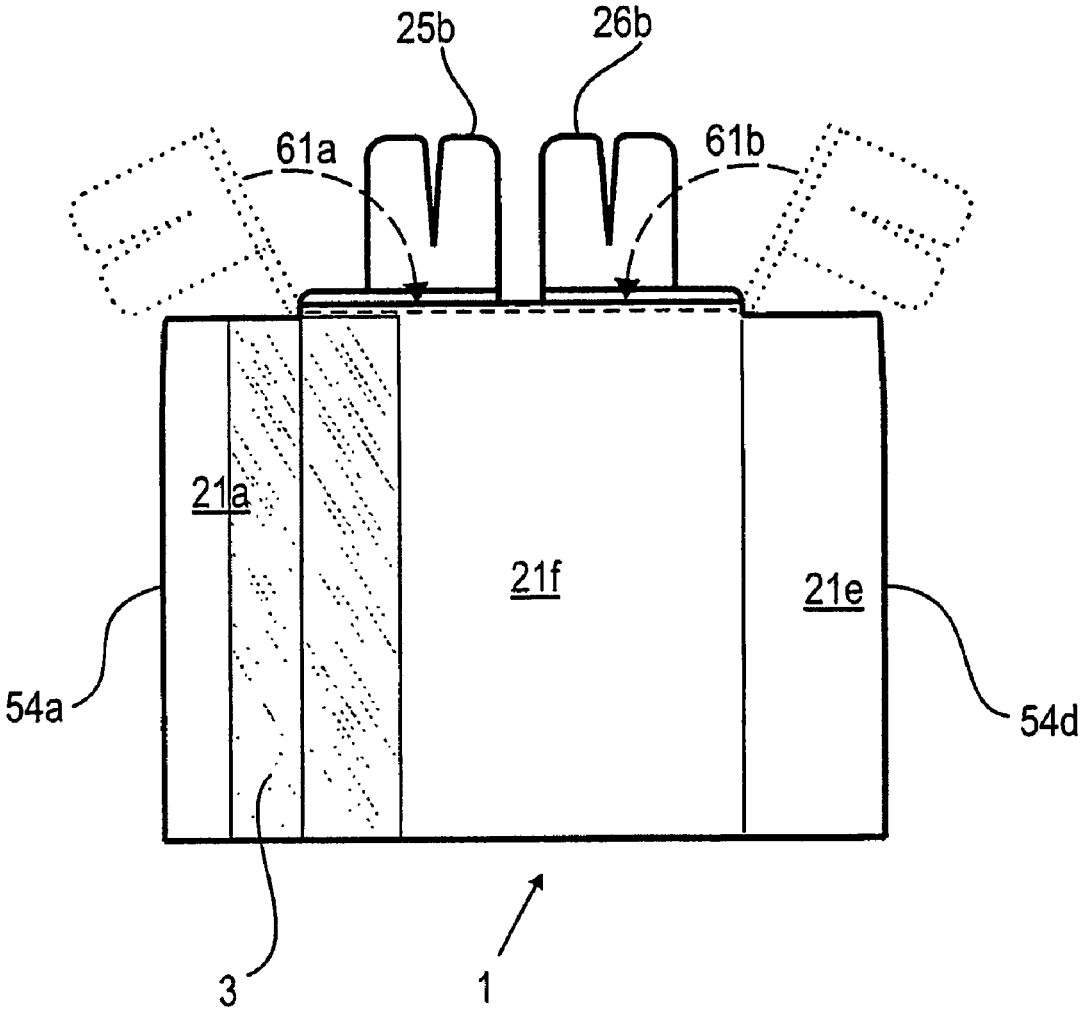
FIG. 3 is the front view of the toilet in the folding phase shown in FIG. 2.

FIG. 2 depicts the first phase of collapsing the toilet 1, where the lateral parts 23*a*, 24*a*; 23*b*, 24*b* of the seat surface segments 12*a*, 12*b* are folded along the fold-lines 52*a*, 52*b*; 52*c*, 52*d* on the top surface of the basic portions 22*a*, 22*b* and in this case the flaps 25*a*, 26*a*; 25*b*, 26*b* are extending upright. The first phase of folding the toilet 1 is also shown in FIG. 3, where arrows depict folding directions 61*a* and 61*b* of folding the lateral parts 23*a*, 24*a*; 23*b*, 24*b* as described above.

Figure 4:
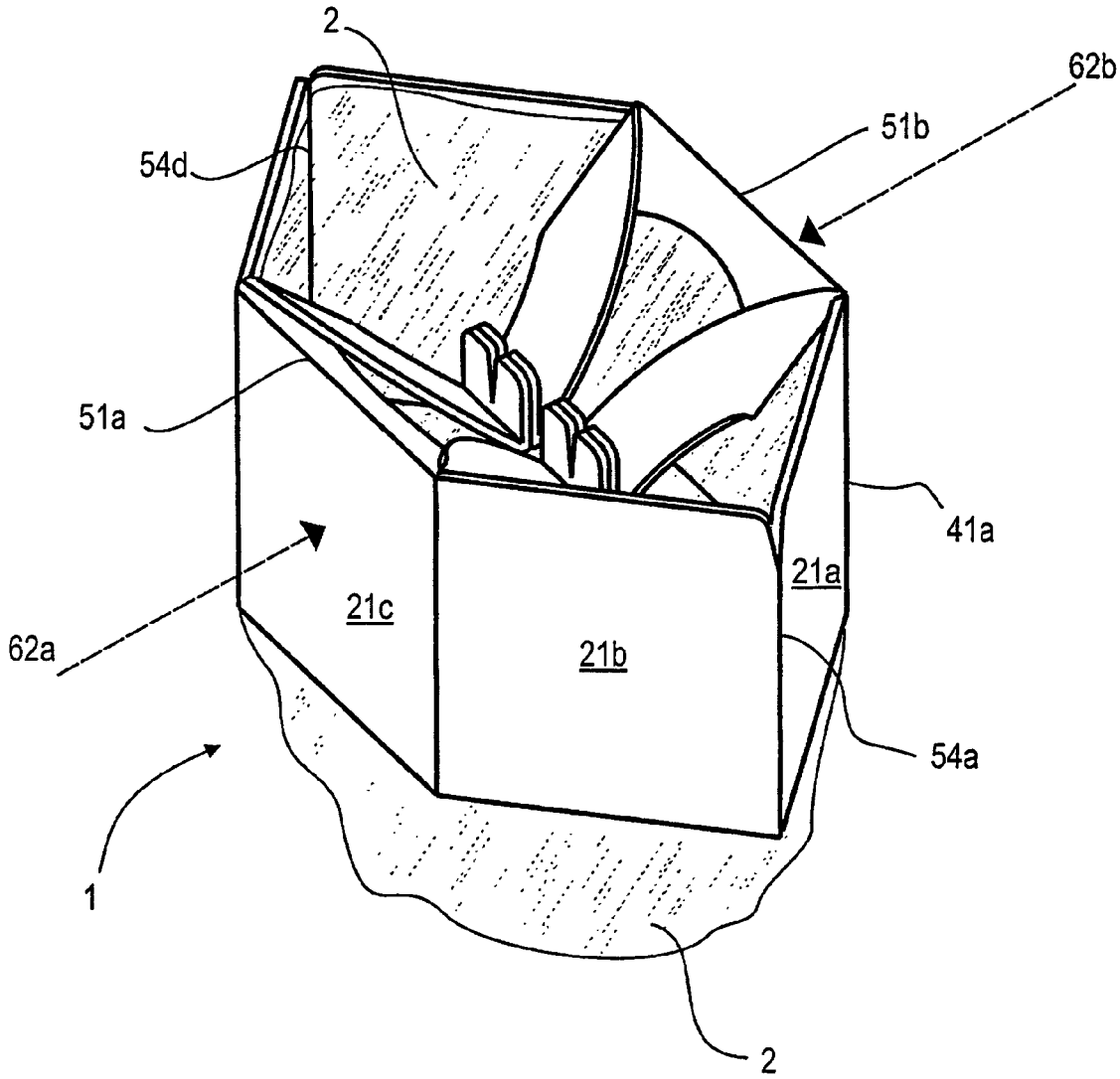
FIG. 4 is a view of the toilet shown in FIG. 1 in the second phase of collapsing.

FIG. 4 shows the toilet 1 in the second phase of collapsing. In this phase, the seat surface segments 12*a*, 12*b* are folded into the inner space 4 by moving towards each other the holding side walls 21*c*, 21*f* in folding directions 62*a* and 62*b*, while the supporting side walls 21*a*, 21*b*, 21*d* and 21*e* are also moved towards each other in pairs. The figure also shows the receptacle bag 2 open at the top and fixed from the inner space 4 to the seat surface segments 12*a*, 12*b* either from the top or on the side walls, the closed bottom part of which is protruding more and more in the second phase of collapsing from the inner space 4 of the toilet 1 which is open at the bottom. The receptacle bag 2 enables hygienic use as well as an appropriate storage of the waste.

Figure 5:
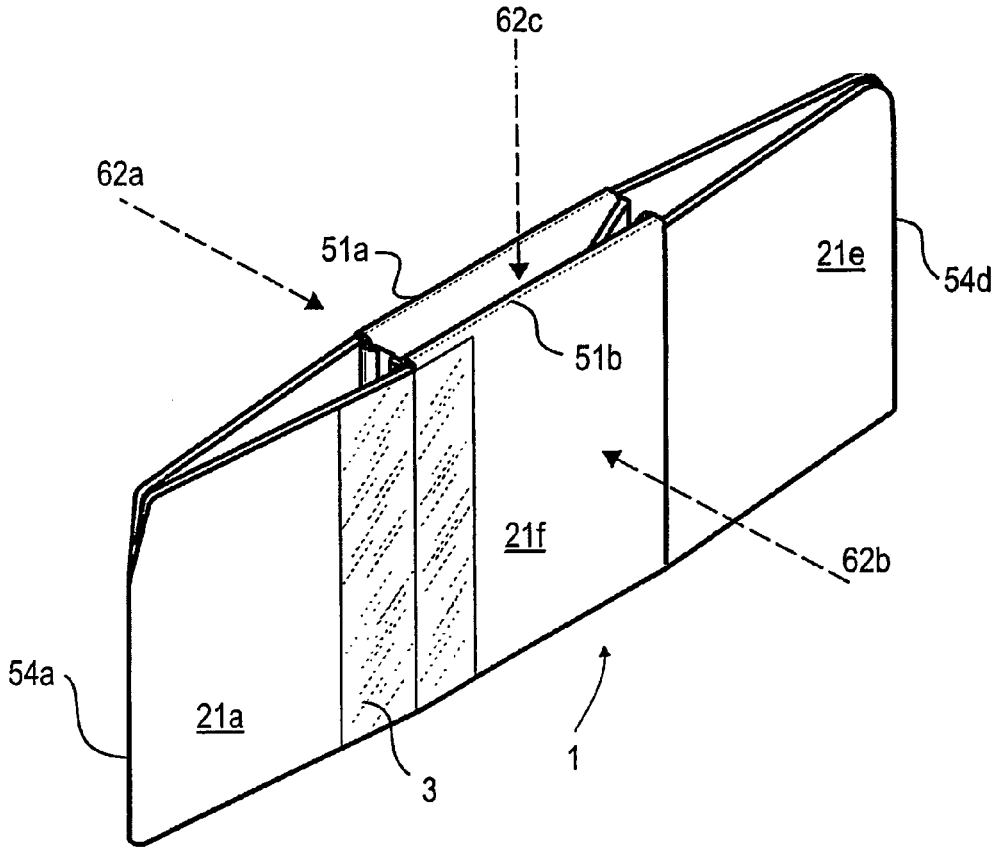
FIG. 5 is a view of the toilet shown in FIG. 1 in the third phase of collapsing.
Figure 6:
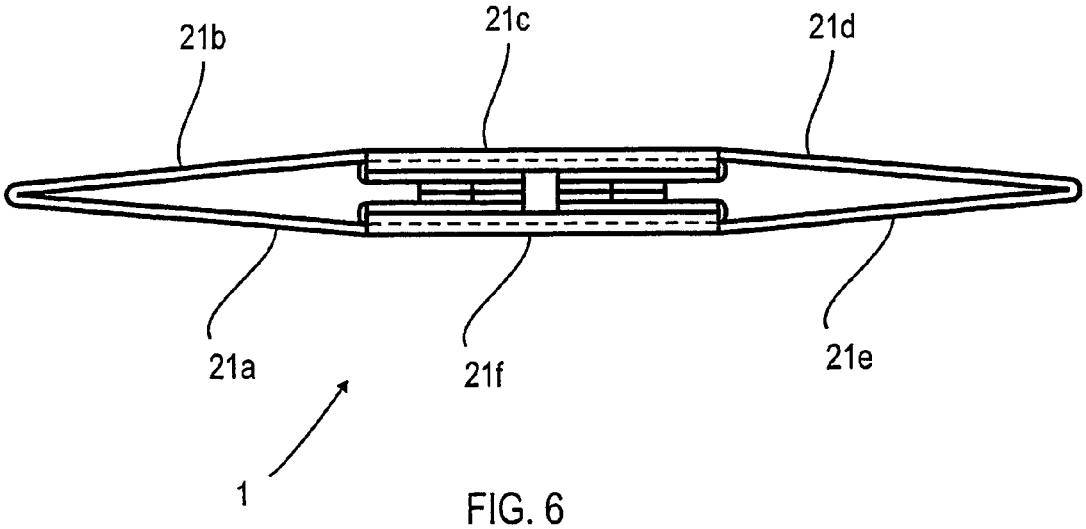
FIG. 6 is a top view of the toilet in a collapsing phase corresponding to FIG. 5.

FIG. 5 shows the third phase of collapsing the toilet 1. In this phase, the seat surface segments 12*a*, 12*b* are fully folded into inner space 4 by pushing in folding direction 62*c* the upright flaps 25*a*, 26*a*; 25*b* and 26*b*, and by pushing the holding side walls 21*c*, 21*f* together. The top view of this phase is shown by FIG. 6, which depicts clearly that by the special folding manner of the seat surface in accordance with the invention, the toilet 1 can be folded extremely flat, while the seat surface is located in a protected way in the inner space 4 of the collapsed toilet 1.

Figure 7:
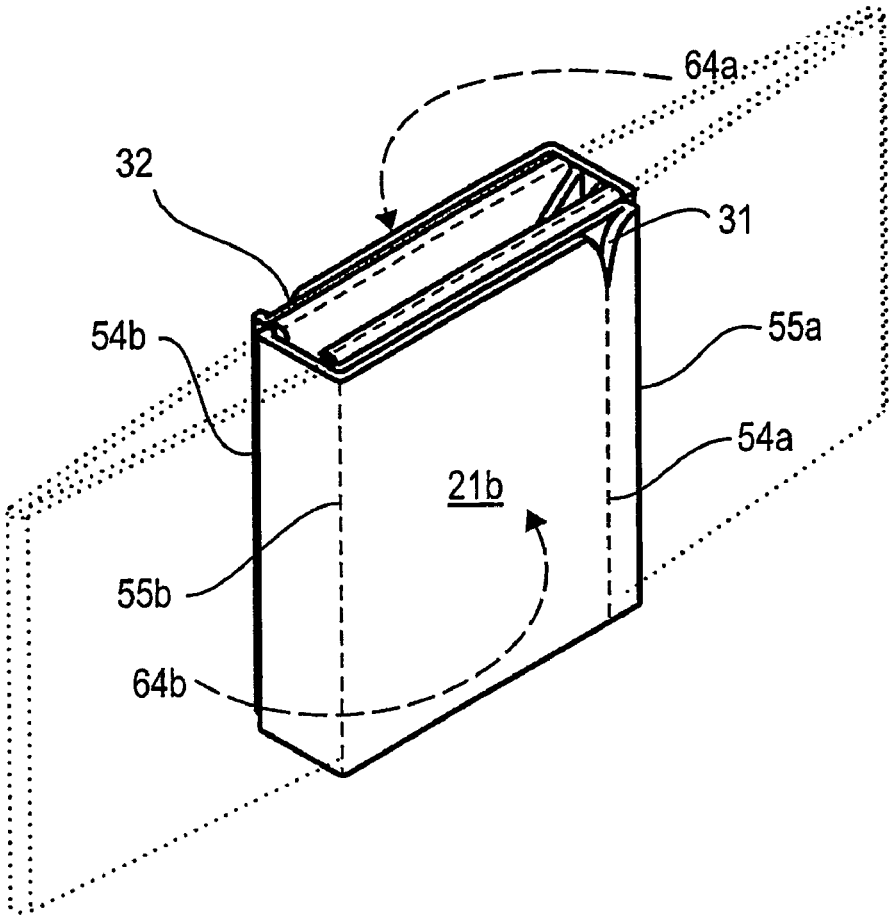
FIG. 7 is a view of the toilet shown in FIG. 1 in a collapsed status.
Figure 8:
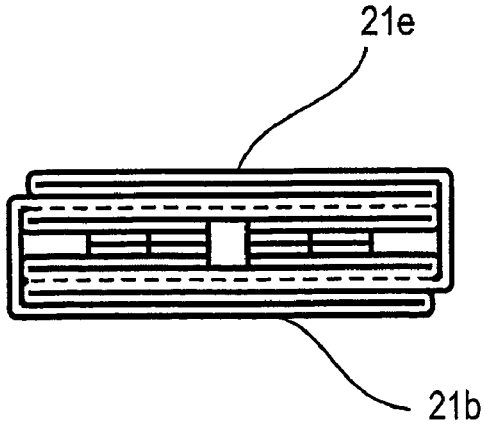
FIG. 8 is a top view of the toilet in a folded condition.
Figure 9:
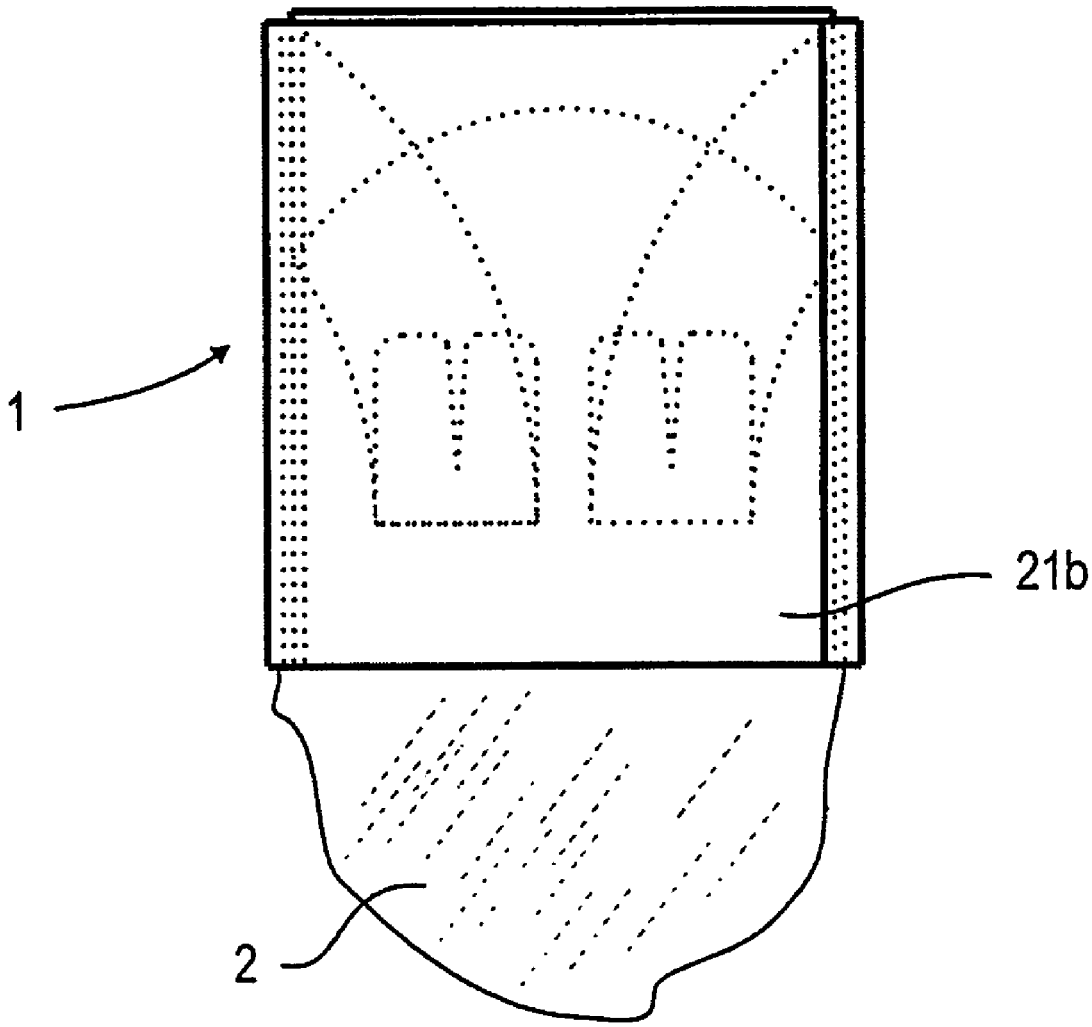
FIG. 9 is a side view of the toilet in a collapsed status with the receptacle bag and, FIG. 10 is a top view of the unfolded sheet material of the toilet shown in FIG. 1.

FIG. 7 shows the toilet 1 in a collapsed position. In this status, the pairs consisting of supporting side walls 21*a*, 21*b*; 21*d*, 21*e* are folded in folding directions 64*a* and 64*b* on the outside of each of the holding side walls 21*c*, 21*f* pushed together. Folding in folding directions 64*a* and 64*b* is assisted by folding lines 55*a*, 55*b*, 55*d* and 55*e* formed in the supporting side walls 21*a*, 21*b*, 21*d* and 21*e*. The fold-lines 55*a*, 55*b*, 55*d* and 55*e* are preferably made by scoring and they are flattened out while opening the toilet 1, consequently they are not shown in FIGS. 1 to 6. The top view of the folded position is shown in FIG. 8 and the side view in FIG. 9, which show clearly the compact size accomplished by folding. In this position, a fixing tape running around the folded bowl, a storing bag or a different removable facility not shown in the figure can be used for securing the folded position.

Unfolding the inventive toilet 1 from its folded position to the unfolded position prior to taking into use is carried out in opposite directions vis-à-vis those described above. First, the pairs consisting of supporting side walls 21*a*, 21*b*; 21*d*, 21*e* are folded out in directions opposite to the folding directions 64*a*, 64*b*, in order to accomplish the phase shown in FIGS. 5 an 6. Next, the phase shown in FIG. 4 is accomplished by pulling apart the holding side walls 21*c*, 21*f* in directions opposite to the folding directions 62*a*, 62*b* and by pulling out the upright flaps 25*a*, 26*a*; 25*b*, 26*b* in a direction opposite to the folding direction 62*c*. Finally, the lateral parts 23*a*, 24*a*; 23*b*, 24*b* of the seat surface segments 12*a*, 12*b* are folded out along the fold-lines 52*a*, 52*b*; 52*c*, 52*d* in directions opposite to the folding directions 61*a*, 61*b* from the top surface of basic portions 22*a*, 22*b* and the slots 33*a*, 34*a*; 33*b*, 34*b* formed in flaps 25*a*, 26*a*; 25*b*, 26*b* are pushed into the further slots 31, 32 in the supporting periphery.

According to the description above, opening out and folding can be carried out quickly, simply and accurately. The lateral parts 23*a*, 24*a*; 23*b*, 24*b* rest on the top edges 42*a*, 42*b*, 42*d*, 42*e*, consequently the load on them is distributed along the supporting side walls 21*a*, 21*b*, 21*d* and 21*e*.

FIG. 10 depicts a top view of the unfolded sheet material of the preferred toilet 1, where it is shown that the toilet 1 is designed from one piece of sheet material by cutting and gluing. The basic edge 11 is hexagonal when the supporting side walls 21*a*, 21*b*, 21*d*, 21*e* and holding side walls 21*c*, 21*f* are folded along the lateral edges 54*a*, 54*b*, 54*c*, 54*d*, 54*e* and the edges 41*a* and 41*b* are glued together. In the sheet material, the fold-lines are preferably made by scoring.

The basic form, cut from the sheet material, must be folded and glued for reaching the status prior to application. The die is folded along the edges 54*a*, 54*b*, 54*c*, 54*d* and 54*e*, and it is glued after matching along the edges 41*a* and 41*b* by means of the adhesive tape 3 or an adhesive flap protruding beyond the edges 41*a*, 41*b* or similar means. Next, the flaps 25*a*, 25*b*, 26*a* and 26*b* are bent along the edges 53*a*, 53*d*, 53*b*, 53*c* and the opposite flaps 25*a*, 25*b* and 26*a*, 26*b* in pairs are glued with each other.

The design of the toilet 1 in a glued initial condition can be completed by the installation of the receptacle bag 2, which is placed or glued in any known way on or below the seat surface segments 12*a* and 12*b* or from the inner space 4 to the side walls. In a folded storage position, the receptacle bag 2 may also be positioned in a protected way enclosed in the inner part of the structure.

It is demonstrated by the description above that the collapsible toilet 1 or potty according to the invention is very light, and can be collapsed to a small flat size for example for the purpose of carrying in a bag or pocket. In addition, it has a design which can be quickly unfolded, taken into use and deployed, and it is also hygienic. The design can be supplemented in the given case with a replaceable and disposable receptacle. After use, the whole potty can be disposed of in a folded and closed way or the disposable receptacle bag 2 can be closed and hygienically disposed. In the latter case, a new receptacle bag 2 can be placed into the toilet 1 and the structure can be quickly packed away, with the original closed status regained without any damage and the unit reused.

The invention is not limited to the actual embodiments described above, but various modifications and changes are possible within the scope of protection. For example the annular seat surface implies not only a circular or elliptical seat edge, but also an arbitrary seat edge of any continuous shape, for example a triangle, square or a different polygonal design. Accordingly, the side walls may not only confine a hexagonal, but also a triangular, square or a different polygonal inner space.

The fold-line in the seat surface can be implemented in the way described above as an intersection of the seat surface segments, but in case the seat surface is made of one piece, the fold-line is provided in the material of the seat surface. The fold-lines of the toilet can be for example scoring lines in the material, but they can also be of a different design, eventually a glued or articulated design.

Fixing the seat surface to the supporting periphery can be implemented not only by slots, but also in any other suitable way.

It will be evident to those skilled in the art that the above disclosure is exemplary only and that various other alternatives, adaptations and modifications may be made within the scope of the present invention as defined by the following claims.

The invention claimed is:

1. A collapsible toilet made of sheet material, the toilet comprising side walls connected to each other at their lateral edges and defining an inner space of the toilet, a seat surface arranged at the upper edges of the side walls, and fold-lines for collapsing the toilet, comprising two opposite holding side walls having top edges to which two edges of an annular seat surface are joined respectively along respective fold-lines, and supporting side walls connecting the holding side walls and having upper edges forming a supporting periphery that supports the seat surface, wherein in the seat surface a fold-line is arranged at an equal distance from the top edges of the holding side walls, said fold-line enabling folding the seat surface into the inner space when the holding side walls are moved towards each other, wherein the seat surface is fixed to the supporting periphery at least at one location, and wherein the seat surface consists of seat surface segments, the said seat surface segments comprising a basic portion joining the top edge of the holding side wall and two lateral parts extending towards the other seat surface segment, wherein opposite lateral parts of the seat surface segments are joined at their ends to each other along the fold-line, and wherein a fixing to the supporting periphery is located at the joining portions of the lateral parts.

2. The toilet according to claim 1, wherein the seat surface is formed of a single piece of sheet material by cutting and gluing, wherein each seat surface segment is continuous with the respective holding side wall separated from it by a fold-line, and the ends of the lateral parts are provided with flaps bent perpendicular to the seat surface and glued to each other in pairs extending towards the supporting periphery, wherein the flaps have slots and are pressed with the slots on the supporting periphery or into further slots in the supporting periphery.

3. The toilet according to claim 2, in that wherein there are two further fold-lines in each seat surface segment extending across a respective endpoint of the top edge of the holding side wall and normal to the edge, the two further fold-lines separating the basic portion from the lateral parts, wherein the lateral parts are folded on the top surface of the basic portion along these further fold-lines when folding the toilet, and the seat surface segments are folded into the inner space with the upright flaps by pushing the holding side walls together.

4. The toilet according to claim 3, having a hexagonal inner space, the two holding side walls are connected to each other by pairs of supporting side walls on the two sides, and the slots in the supporting periphery are formed in each pair along the joint lateral edge of the supporting side walls.

5. The toilet according to claim 4, having a folded position, in which the pairs of the supporting side walls are folded onto the outside of the respective pushed-together holding side walls.

* * * * *